US008562037B2

(12) United States Patent
Ieda et al.

(10) Patent No.: US 8,562,037 B2
(45) Date of Patent: Oct. 22, 2013

(54) VEHICLE HANDLE

(75) Inventors: Kiyokazu Ieda, Chiryu (JP); Takamasa Fujitsuna, Anjo (JP); Takeshi Ito, Chiryu (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 1294 days.

(21) Appl. No.: 11/628,027

(22) PCT Filed: Jun. 21, 2005

(86) PCT No.: PCT/JP2005/011315

§ 371 (c)(1),
(2), (4) Date: Nov. 30, 2006

(87) PCT Pub. No.: WO2006/001263

PCT Pub. Date: Jan. 5, 2006

(65) Prior Publication Data

US 2008/0256755 A1 Oct. 23, 2008

(30) Foreign Application Priority Data

Jun. 23, 2004 (JP) ..... 2004-185076

(51) Int. Cl.
*E05B 3/00* (2006.01)

(52) U.S. Cl.
USPC ..... 292/336.3

(58) Field of Classification Search
USPC ..... 292/336.3, DIG. 30; 16/110.1
See application file for complete search history.

(56) References Cited

U.S. PATENT DOCUMENTS

| | | | | | |
|---|---|---|---|---|---|
| 3,148,905 | A * | 9/1964 | Chanaryn | 292/336.3 |
| 4,065,164 | A * | 12/1977 | Bartels | 292/347 |
| 4,349,722 | A * | 9/1982 | Kurth et al. | 219/202 |
| 5,462,482 | A * | 10/1995 | Grimes | 454/143 |
| 6,577,228 | B1 * | 6/2003 | Tsuchida et al. | 340/5.72 |
| 6,740,834 | B2 | 5/2004 | Sueyoshi et al. | |
| 6,768,413 | B1 * | 7/2004 | Kemmann et al. | 340/5.72 |
| 6,907,643 | B2 * | 6/2005 | Koops et al. | 16/438 |
| 7,544,319 | B2 * | 6/2009 | March et al. | 264/328.1 |

(Continued)

FOREIGN PATENT DOCUMENTS

| | | | |
|---|---|---|---|
| JP | 6-033155 | Y2 | 8/1994 |
| JP | 2001-520337 | A | 10/2001 |
| JP | 2002-030844 | A | 1/2002 |

(Continued)

OTHER PUBLICATIONS

Office Action issued Jul. 29, 2010 by the Japanese Patent Office in Japanese Patent Application No. 2006-528530 and partial English translation.

International Search Report dated Oct. 4, 2005.

*Primary Examiner* — Kristina Fulton

(74) *Attorney, Agent, or Firm* — Buchanan, Ingersoll & Rooney PC

(57) ABSTRACT

A vehicle handle (20) having handle joining sections (20*e*, 20*f*) joining with a door panel of a vehicle in addition to having a non-contact type detection sensor in a handle interior space (s), and performing at least unlocking of a door in accordance with detection information from the detection sensor, comprises an internal water discharging path (G) communicating between the handle interior space (s) and a handle exterior space (S) and capable of discharging water inside the handle interior space (s) to the handle exterior space (S).

25 Claims, 8 Drawing Sheets

(56) References Cited

U.S. PATENT DOCUMENTS

| | | | | |
|---|---|---|---|---|
| 7,770,945 | B2 * | 8/2010 | Umino | 292/201 |
| 2003/0122556 | A1 | 7/2003 | Sueyoshi et al. | |
| 2004/0262139 | A1 | 12/2004 | Ieda et al. | |
| 2004/0262927 | A1 * | 12/2004 | Fukunaga et al. | 292/216 |

FOREIGN PATENT DOCUMENTS

| | | | |
|---|---|---|---|
| JP | 2003-193705 | A | 7/2003 |
| JP | 2003-221946 | A | 8/2003 |
| JP | 2003-221949 | A | 8/2003 |
| JP | 2004-176343 | A | 6/2004 |

* cited by examiner (a)

(b)

VEHICLE HANDLE

TECHNICAL FIELD

The present invention relates to a vehicle handle having a handle joining section joining with a door panel of a vehicle, in addition to having a non-contact type detection sensor in a handle interior space, and performing at least unlocking of a door in accordance with detection information from the detection sensor.

BACKGROUND ART

Conventionally, a vehicle handle is joined (attached) to a door panel through a handle joining section thereof. For example, a handle of a side door is mounted approximately horizontally on a door panel.

Recently, in terms of vehicle handles of this type, vehicle handles automatically unlocking a door when a vehicle user possessing an electronic key or electronic card to prove his or her identity as user approaches the door and touches the handle, and vehicle handles performing locking when the user exits from inside the vehicle and operates a manual switch mounted on the handle have existed as systems performing unlock and lock operations of a door. Systems of this type are called smart entry systems and have unlock operation sensors (called "detection sensors" in the present application) in order to execute unlocking of a door in cases where the above-described user touches the handle. Static-electricity type capacity sensors are typical of unlock operation sensors of this type.

Vehicle handles having a function detecting the fact that a user as mentioned above has touched a handle have existed up to now (patent document 1).

In the construction described in this document, the capacity of equivalent parallel plate electrodes formed between a sensor electrode installed inside a vehicle handle and a body is used, and a change in capacity occurring as a result of an object of a different medium constant to that of air, for example, a hand of a user, entering between the handle and the body is detected.

A touch sensor using a plurality of electrodes is also known (patent document 2) as an example using a capacity detection type sensor of this variety.

In this conventional art, with an aim of guaranteeing favorable operation in poor environments such as when exposed to a large volume of rain water, the vehicle handle is encased, sealant (posting material as indicated in paragraph number 0070) is injected into the space inside the case and hardened, waterproofing is performed, and detection performance is guaranteed (this construction will be referred to as "conventional construction 1").

Meanwhile, vehicle handles having a waterproof construction making the entire outer frame of the vehicle handle a single body and requiring no injection of sealant into the entire interior of the case also exist (this construction will be referred to as "conventional construction 2").

Patent document 1: JP 2001-520337A (FIG. 1)

Patent document 2: JP 2003-221949A (claim 3, paragraph 0070)

However, when employing the above-mentioned conventional construction 1, mass-productivity becomes limited as the construction becomes complicated, such as requiring an injection step for the sealant.

Meanwhile, when employing the above-mentioned conventional construction 2, since waterproofing at the outer frame side becomes necessary, the space that can be put to effective use within limited space of the vehicle handle becomes restricted. Furthermore, protection regions, which are originally unneeded and are not product functions, become necessary.

The present application, for example, consists of providing a vehicle handle that can be supplied for a smart entry system capable of guaranteeing favorable operation in a poor environment.

BRIEF SUMMARY OF THE INVENTION

The characteristic construction of a vehicle handle for achieving the above-described aim, having a handle joining section joining with a door panel of a vehicle in addition to having a non-contact type detection sensor in a handle interior space, and performing at least unlocking of a door in accordance with detection information from the detection sensor is;

the provision of an internal water discharging path communicating between the handle interior space and the handle exterior space and capable of discharging water inside the handle interior space to the handle exterior space.

By providing the internal water discharging path within the handle in this construction, water having entered into, or accumulated in, the handle is discharged to the handle exterior space through the discharging path.

As a result, it is possible to maintain the environment inside the handle in a relatively favorable condition with respect to water (a condition of no water or little water), and the need to provide the entire handle with a waterproof construction or to perform extra operations such as the charging of sealant into the handle interior is removed.

As a result, with relatively simple construction, for example, even in a case where the detection sensor is a capacity sensor, favorable detection with reduced influence of water can be performed.

More specifically, in the forming of the internal water discharging path, it is preferable that a water extraction hole communicating from the handle interior space to the handle exterior space be provided in the handle joining section.

By providing the water extraction hole in the handle joining section, the water is made to follow the handle joining section and a door panel that is substantially in contact therewith in order to discharge the water from the handle interior space to the handle exterior space, and favorable discharge of water can be performed.

Furthermore, it is preferable in the forming of the internal water discharging path that a water extraction guide path for directing the water inside the handle interior space to the water extraction hole be provided at a handle inner wall surface defining the handle interior space.

By employing a construction of this type, water inside the interior space can be guided to the water extraction hole and promptly discharged.

Furthermore, it is preferable in the forming of the internal water discharging path that a downward guide surface facing downward in a vertical direction in a joining posture corresponding to a condition wherein the handle is joined to the vehicle door panel be provided at a handle inner wall surface defining the handle interior space.

In this case, as long as facing downward in the joining posture, it is sufficient not only to be oriented in a vertical direction, but also to be oriented in an inclined downward direction, and water can be guided in a downward direction using gravity and processed.

Furthermore, as a construction having a handle body and a handle cover mutually engaged with the handle body, wherein the handle interior space is formed between the handle body and the handle cover;

it is preferable in the forming of the internal water discharging path that a portion thereof be provided in the mutual-engagement joining section of the handle body and the handle cover.

As a result of the mutual-engagement joining section constituting a portion of the internal water discharging path, the mutual-engagement joining section can serve a role both of mutual engagement and of water discharge.

Furthermore, it is preferable in the formation of the internal water discharging path that a space be provided in the vicinity of the handle joining section and that a wall of the space be formed as a portion of the internal water discharging path.

This space can also serve to discharge internal water by, for example, being made a space region connected to the water extraction hole.

Furthermore, it is preferable that handle joining sections be provided at both ends along an axis of a grip section, and that the internal water discharging paths be formed so as to become more distant from the axis as the internal water discharging paths extend to the handle joining sections.

As a result, regardless of the orientation at which the handle is installed, the internal water discharging path has a downward inclination facing from the handle interior space to the handle exterior space. Consequently, water can flow with certainty from the handle interior space towards the handle exterior space.

Furthermore, it is preferable that the internal water discharging path be provided in the interval from the grip section to the handle joining section.

Favorable discharge of water can be performed by making water inside the handle interior space flow towards both end sides from an area inside the grip section and follow the handle joining sections and the door panels that are substantially in contact therewith.

Furthermore, it is preferable that a flow path cross-section area wherein flowing of water is possible be progressively enlarged as the internal water discharging path extends towards the handle exterior space.

By reducing a resistance of the water as transition from the handle interior space to the handle exterior space takes place, the water inside the handle interior space is allowed to flow more easily towards the handle exterior space.

Furthermore, it is preferable that non-woven cloth be provided at the water extraction holes.

Since the water inside the handle interior space becomes able to follow the non-woven cloth, the flow path of water extending from the handle interior space to the handle exterior space can be regulated by the non-woven cloth, and discharge of the water can be performed with certainty.

In the vehicle handle described thus far, by equipping a passenger-compartment exterior antenna for communication of the vehicle and the portable device and a lock operation detection means for performing lock operations, a smart entry system can be realized beyond doubt using a relatively simple vehicle handle.

Furthermore, in this configuration, since the wire harness of the detecting sensor, passenger-compartment exterior antenna, and lock operation detection means, connected to the vehicle interior, is arranged from a handle joining section, the wire harness becomes easy to handle, and in addition, a wire harness with sufficient function protection can be realized.

A capacity sensor, proximity sensor, etc. can be used for the detection sensor described thus far.

DETAILED DESCRIPTION OF THE INVENTION

The following is a description of a case wherein a vehicle handle 20 of the present application is adapted to a smart entry system 1. In the description, a configuration and an action of the smart entry system 1 are described first of all, and then, the vehicle handle 20 according to the present application is described.

Figure 3:
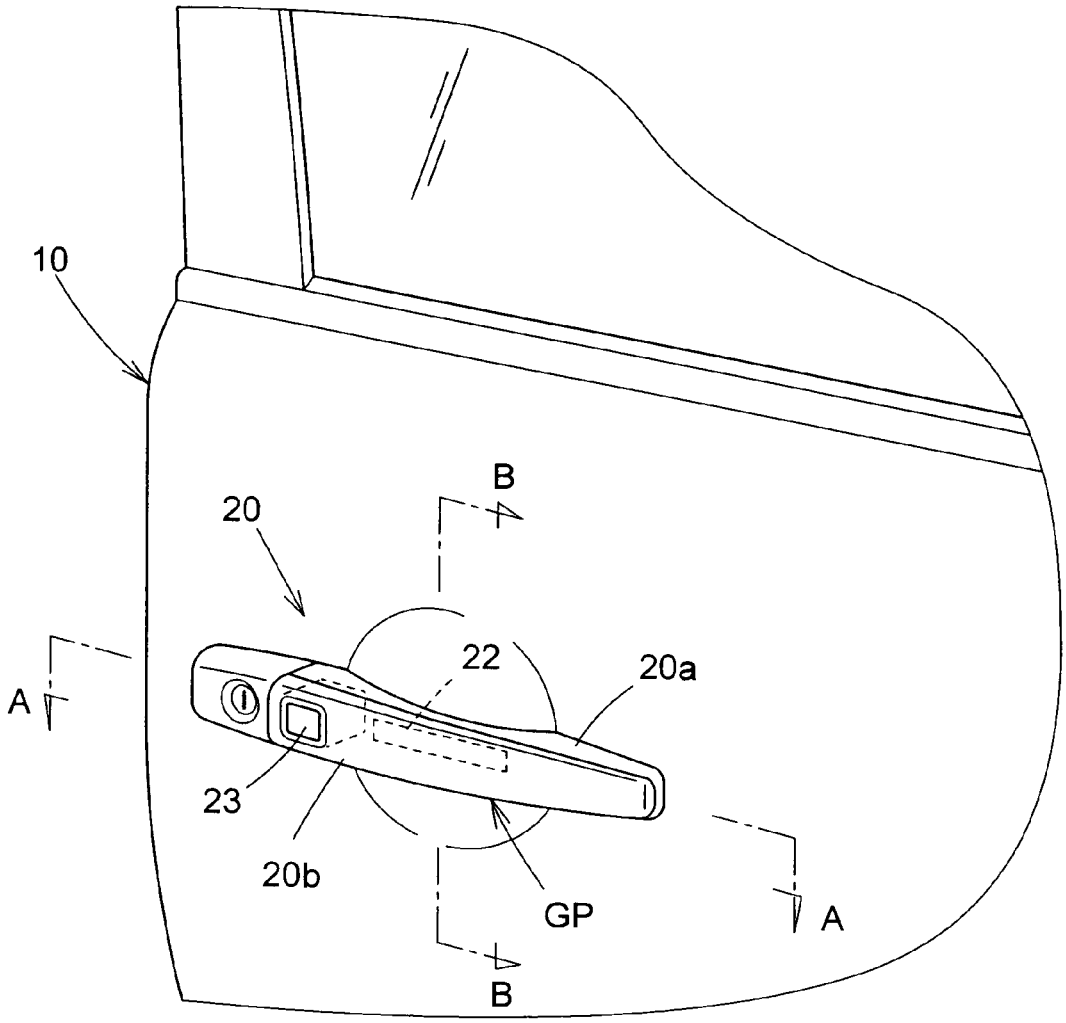
FIG. 3: Exterior drawing showing an attachment condition of the handle.

FIG. 3 is a view showing an attachment condition of the vehicle handle 20, and the vehicle handle 20 is a grip-type handle gripped by a hand at a central grip section GP and, as a result of operation thereof, makes possible an opening operation of a vehicle door. It should be noted that, in this embodiment, although the handle is a grip-type handle, this embodiment is not restricted thereto.

[Smart Entry System]

1. Overview of Operation of Smart Entry System

In the smart entry system 1, locking and unlocking operations of a door are performed in the following sequence.

1. In a locked condition, preparation for an unlocking operation pursuant to a user's approach (unlock preparation), 2. Unlocking as a result of the user making contact with the handle (unlock execution), 3. In an unlocked condition, preparation for a locking operation pursuant to the user relocating to outside the vehicle (lock preparation), and 4. Locking as a result of the user making contact with the handle (lock execution).

Figure 1:
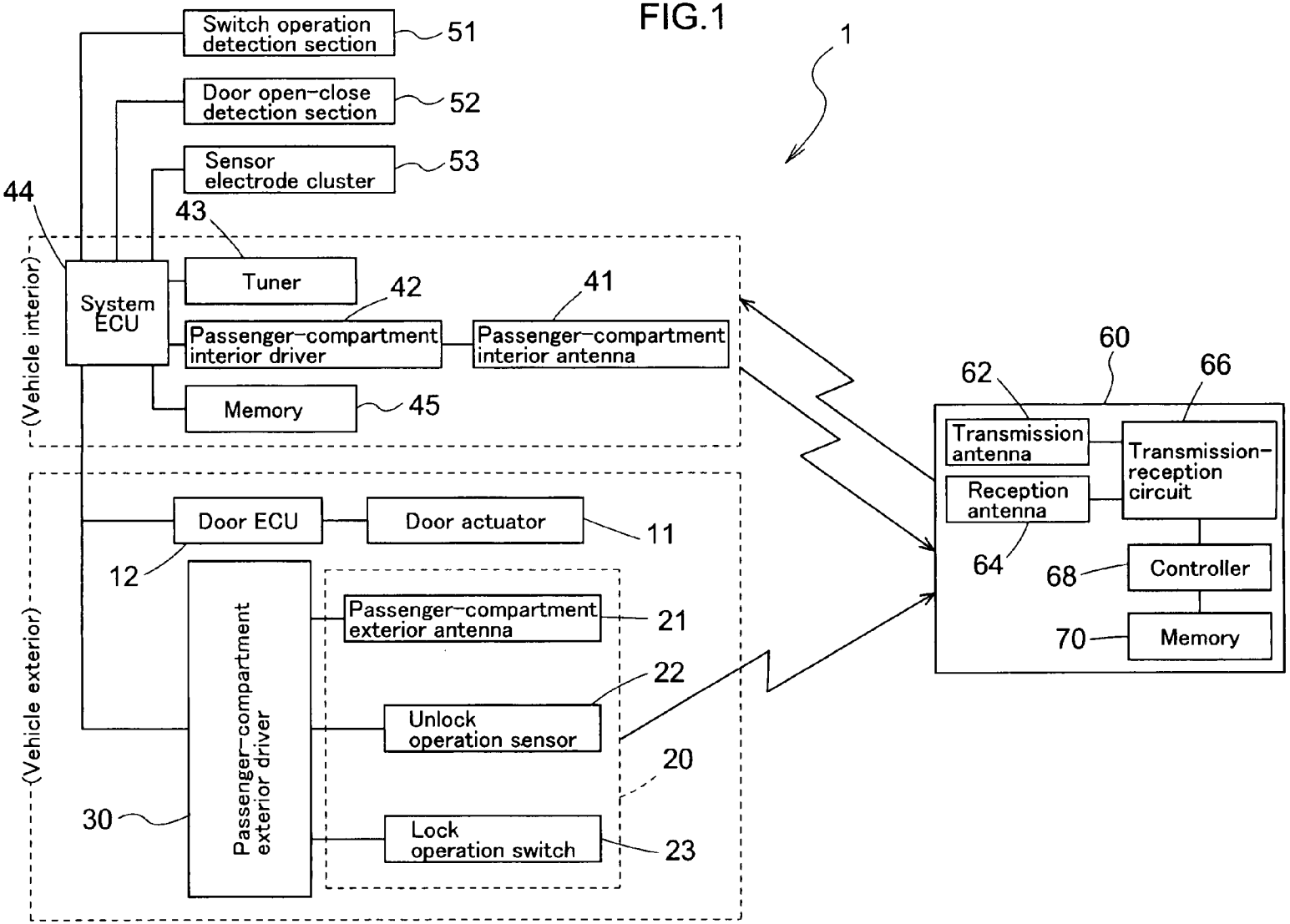
FIG. 1: System block diagram of a smart entry system employed in a vehicle having a handle according to an embodiment of the present invention.

In these steps, within the vehicle handle 20 according to the present application, the devices provided in the vehicle handle 20 (as shown in FIG. 1, a passenger-compartment exterior antenna 21, an unlock operation sensor 22, and a lock operation switch (an example of a lock operation detection means) 23) act in the following way.

1. Action of the Devices in the Vehicle Handle 20 During Unlock Preparation

During unlock preparation, it is judged that a portable device 60 such as a key or electronic card retained by the user has become close to the vehicle. With respect to this judgment, the passenger-compartment exterior antenna 21 within the vehicle handle 20 transmits a vehicle-exterior request signal.

2. Action of the Devices in the Vehicle Handle 20 Pursuant to Unlock Execution Unlock execution detects that the user has made contact with the vehicle handle 20, and in accordance with this detection, performs unlocking. Therefore, a capacity sensor in the form of the unlock operation sensor 22 provided within the vehicle handle 20 detects the condition of the handle with respect to contact by the user.

4. Lock Execution

Lock execution detects that the user has made contact with the lock operation switch 23, and in accordance with this detection, performs locking.

Therefore, in this system 1, with user's movement toward/away to the vehicle as a starting point, a contact operation, etc. of the user is detected and locking/unlocking of the door can be performed without an operation of a vehicle key.

The following is a detailed description of a configuration and an action of the system.

2. Configuration of Smart Entry System 1

Figure 2:
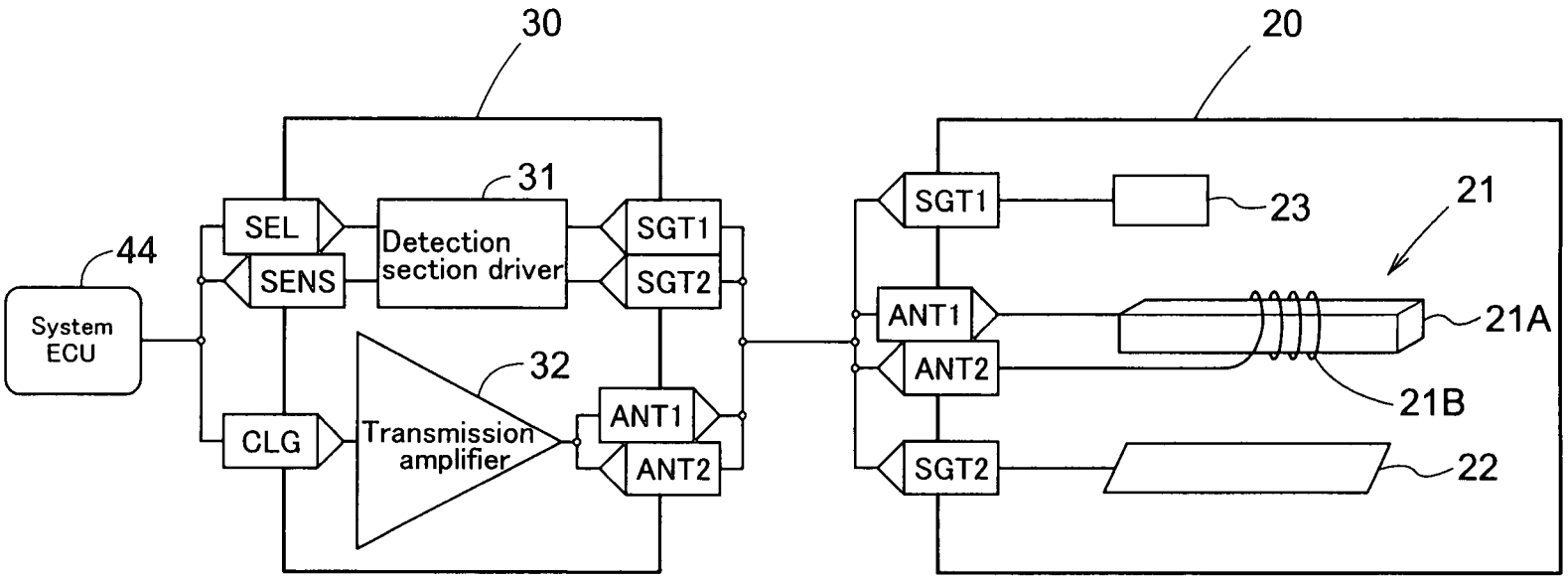
FIG. 2: Detailed block diagram of the handle of FIG. 1 and of a passenger-compartment exterior driver.

A system configuration will be described based on FIG. 1 to FIG. 3. FIG. 1 is a block diagram of the system 1, and FIG. 2 is a block diagram showing an exchange of signals between the vehicle handle 20 and a passenger-compartment exterior driver 30.

2-1. Vehicle-Side System Configuration

As shown in FIG. 1, a door actuator 11 unlocking and locking a vehicle door and a door-use electronic control unit (hereinafter referred to as an "door ECU") 12 controlling an operation of the door actuator 11 are mounted on the passenger-compartment exterior side of a door panel 10. Furthermore, within the door panel 10, a vehicle handle 20 of a constitution unique to the present application is provided, and in addition, a passenger-compartment exterior antenna 21 communicating with the vehicle exterior is built into the vehicle handle 20, and the passenger-compartment exterior driver 30 for the passenger-compartment exterior antenna 21 is provided. Furthermore, the unlock operation sensor 22 and the lock operation switch 23 are provided within the vehicle handle 20.

Within the vehicle, a passenger-compartment interior antenna 41 for performing communications in the vehicle, a passenger-compartment interior driver 42 connected to the passenger-compartment interior antenna 41, a tuner 43, and a system ECU 44 are provided.

The passenger-compartment interior antenna 41 is provided at a location such as the center console of the passenger compartment where electromagnetic waves can be radiated to the interior of the vehicle. The system ECU 44 is connected to the passenger-compartment interior driver 42 and the tuner 43. The tuner 43 is mounted on an inner mirror, etc. of the interior of the vehicle.

In this system 1, a switch operation detection section 51 detecting an operation of switches such as an ignition, a door open-close detection section 52 detecting opening and closing of a door, and a sensor electrode cluster 53 detecting vehicle speed and opening and closing of a window using various sensor electrodes are connected to the system ECU 44.

The system ECU 44 sends a request signal (vehicle-exterior request signal and vehicle-interior request signal) to each of the passenger-compartment exterior driver 30 and the passenger-compartment interior driver 42. In this embodiment, a request signal having a carrier frequency of 134 kHz is transmitted from the passenger-compartment exterior antenna 21 and the passenger-compartment interior antenna 41 with respect to the portable device 60 as a vehicle-exterior request signal and a vehicle-interior request signal, respectively.

Furthermore, an ID information signal that is output from the portable device 60 is received in the tuner 43. In this embodiment, the ID information signal uses a carrier frequency of 315 MHz. The signal is demodulated in the tuner 43 and input to the system ECU 44.

The system ECU 44 has a function capable of recording codes such as a code performing unlock and lock of a vehicle door, a code performing startup of an engine, and a code for verification of a transponder ID in a memory 45, even in a condition where a source of power is interrupted.

2-2. Configuration of Portable Device Side

The portable device 60 has a transmission antenna 62 and a reception antenna 64. The transmission antenna 62 transmits an ID information signal with a carrier frequency of 315 MHz with respect to the vehicle. The reception antenna 64 receives an ID request signal with a carrier frequency of 134 kHz transmitted from the vehicle. The transmission antenna 62 and the reception antenna 64 are connected to a transmission-reception circuit 66 connected to a controller 68.

A request signal from the vehicle side received in the reception antenna 64 of the portable device 60 (vehicle-exterior request signal) is demodulated in the transmission-reception circuit 66 and input to the controller 68. The controller 68 transmits a code recorded inside a memory 70 to the transmission-reception circuit 66. The code includes ID information, is modulated in the transmission-reception circuit 66, and is transmitted from the transmission antenna 62 with respect to the tuner 43 using a signal with a carrier frequency of 315 MHz.

2-3. Relationship Between Handle Interior Devices and the Passenger-Compartment Exterior Driver 30

FIG. 2 is a block diagram describing handle interior devices and the passenger-compartment exterior driver 30.

The passenger-compartment exterior driver 30 is configured having a detection section driver 31 and a transmission amplifier 32. The vehicle-exterior request signal output from the system ECU 44 is input into a CLG terminal, modulated and amplified in the transmission amplifier 32, sent to the passenger-compartment exterior antenna 21 connected to each of an ANT1 terminal and an ANT2 terminal, and transmitted as an electromagnetic wave to the exterior of the vehicle.

In a door unlock detection mode and a door lock detection mode, a signal output from the system ECU 44 is input to a SEL terminal and starts the detection section driver 31 connected to the SEL terminal. The detection section driver 31 detects the lock operation switch 23 through an SGT1 terminal and detects the unlock operation sensor 22 through an SGT2 terminal, respectively. It should be noted that the passenger-compartment exterior antenna 21, the unlock operation sensor 22, and the lock operation switch 23 are connected electrically by a signal line to the above-mentioned various terminals.

The passenger-compartment exterior antenna 21 comprises a ferrite core 21A of a rectangular parallelepiped shape and a coil 21B wound perpendicular to a longitudinal direction of the ferrite core 21A. The passenger-compartment exterior antenna 21 can have any desired use frequency band as long as it can be positioned within the vehicle handle 20.

The lock operation switch 23 is a push-in switch adopting an On condition while a pressing operation of the user is being performed, is built into a specific region at the front side of the vehicle handle 20 (bottom side of FIG. 4) where a finger of the user presses when locking, and is capable of recognizing an operation of the vehicle handle 20 performed when the user closes (locks) the vehicle door.

The unlock operation sensor 22 is a static-electricity capacity type sensor, an electrode thereof being build into the rear side of the vehicle handle 20 (top side of FIG. 4), and is capable of recognizing an operation (contact of the user and the vehicle handle 20) of the vehicle handle 20 when the user opens (unlocks) the vehicle door.

It should be noted that, in this embodiment, although the above-described lock operation switch 23 is provided for a lock operation action by the user, this embodiment may be changed to have a static-electricity capacity type sensor detecting operation of the vehicle handle 20 by the user from a change in static capacity when the user touches the vehicle handle 20, similar to the unlock operation sensor 22.

2-4. Action of Unlock Operation Sensor

Figure 4:
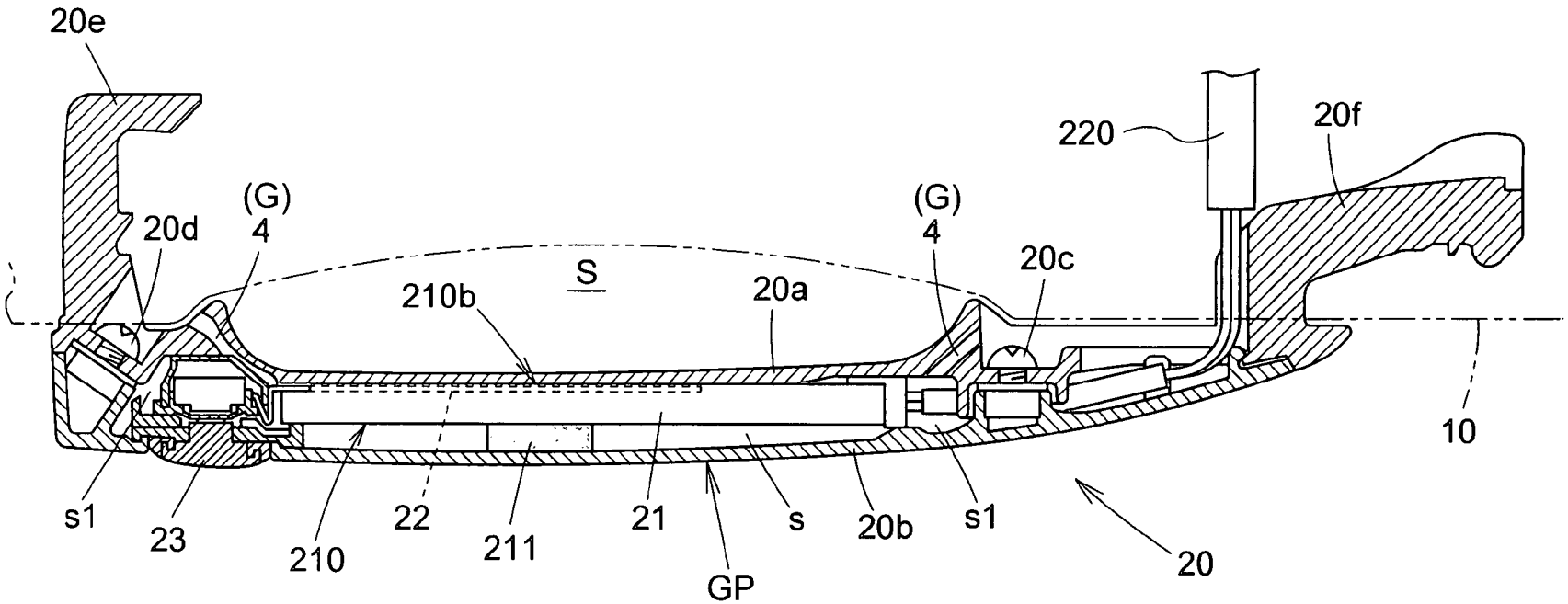
FIG. 4: Cross-sectional view along A-A of FIG. 3.

When the user opens the vehicle door, since a hand of the user grips and pulls the vehicle handle 20, the hand of the user makes contact with the rear side of the vehicle handle 20 (a handle exterior space S side of FIG. 4). As a result, the unlock operation sensor 22 detects an opening operation of the vehicle door as a result of the handle operation of the user. The detection section driver 31 detects a change in the signal from the SGT2 terminal at this time, and the detection section driver 31 transmits a sense signal to the system ECU 44 through a SENS terminal.

2-5. Action of Lock Operation Switch

When the user closes the vehicle door, since a hand of the user touches the front side of the vehicle handle 20 and presses the lock operation switch 23, the lock operation switch 23 detects the closing operation of the vehicle door as a result of the handle operation of the user.

The detection section driver 31 detects a change in the signal from the SGT1 terminal at this time, and the detection section driver 31 transmits a lock signal to the system ECU 44 through the SENS terminal.

2-6. Operation of Smart Entry System

When the vehicle is parked, the system ECU 44 transmits a request signal to the passenger-compartment exterior driver 30 within the door panel 10, and a vehicle-exterior request signal (134 kHz) is transmitted as an electromagnetic wave from the passenger-compartment exterior antenna 21 towards the exterior of the vehicle.

When the user approaches the vehicle together with the portable device 60, the reception antenna 64 of the portable device 60 receives the vehicle-exterior request signal from the vehicle, and through the transmission-reception circuit 66, the controller 68 processes the vehicle-exterior request signal. Then, through the transmission-reception circuit 66, the controller 68 transmits an ID information signal (315 MHz) from the transmission antenna 62.

As a result of the tuner 43 receiving the ID information signal and relaying the ID information signal to the system ECU 44, the system ECU 44 recognizes that the portable device 60 had approached the vehicle. The system ECU 44, upon recognizing that the portable device 60 has approached, transitions to door unlock mode in order to confirm an opening operation of the vehicle door by the user.

In door unlock mode, detection of a sense signal by the unlock operation sensor 22 is carried out from the system ECU 44 through the passenger-compartment exterior driver 30.

From this condition, when the user grips the vehicle handle 20, a sense signal is transmitted from the unlock operation sensor 22 through the passenger-compartment exterior driver 30 to the system ECU 44. The system ECU 44 processes the sense signal and transmits a door unlock signal to the door ECU 12. As a result, the door actuator 11 performs an unlocking operation of the vehicle door.

When the user is inside the vehicle, the system ECU 44 transmits a request signal to the passenger-compartment interior driver 42, and a request signal is transmitted as an electromagnetic wave from the passenger-compartment interior antenna 41 towards the interior of the vehicle. When the portable device 60 is inside the vehicle, the request signal from the passenger-compartment interior antenna 41 is received within the portable device 60, and in a similar way to that described above, the ID information signal transmitted from the transmission antenna 62 is received in the tuner 43. From this condition, when the user opens the vehicle door and goes outside the vehicle, the portable device 60 becomes unable to receive the request signals from the passenger-compartment interior driver 42 and the passenger-compartment interior antenna 41.

For this reason, transmission of the ID information signal based on the request signal from the passenger-compartment interior antenna 41 is interrupted, and the system ECU 44 recognizes that the portable device 60 has gone out from the interior of the vehicle to the exterior of the vehicle (the user has exited the vehicle). When the portable device 60 goes out from the interior of the vehicle to the exterior of the vehicle and the vehicle door is closed, the system ECU 44 transitions to door lock mode.

In door lock mode, detection of a lock signal by the lock operation switch 23 is carried out from the system ECU 44 through the passenger-compartment exterior driver 30.

From this condition, when the user touches the vehicle handle 20 and pushes the lock operation switch 23, a lock signal is transmitted from the lock operation switch 23 through the passenger-compartment exterior driver 30 to the system ECU 44. Then, the system ECU 44 processes the lock signal and transmits a request signal to the passenger-compartment exterior driver 30, and a request signal is transmitted as an electromagnetic wave from the passenger-compartment exterior antenna 21 to the exterior of the vehicle.

At this time, since the user is, together with the portable device 60, in close proximity to the vehicle door, an ID information signal is transmitted from the portable device 60. On the vehicle side, the tuner 43 receives the ID information signal and transmits the ID information signal to the system ECU 44. Upon confirmation in this way that the user (portable device 60) is outside the vehicle, the system ECU 44 transmits a door lock signal to the door ECU 12, and the door actuator 11 performs a lock operation of the vehicle door.

3. Vehicle Handle 3-1. Configuration of Vehicle Handle

As described above, in the vehicle handle 20 according to the present application, the passenger-compartment exterior antenna 21 etc. is equipped in an interior space s thereof, and in addition, the unlock operation sensor 22 is provided on the door panel 10 side (a side opposing the vehicle body), and the lock operation switch 23 is provided on an opposite side to the door panel (a side away from the vehicle body).

As shown in FIG. 4, the vehicle handle 20 is configured having a handle cover 20*b* and a handle body 20*a* matching the cover 20*b*.

These are configured to be capable of mutual engagement, and in an assembled condition, a configuration wherein an antenna assembly 210 configured mainly composed of the passenger-compartment exterior antenna 21 is inserted and held within the space s formed between both is employed. Furthermore, a front side joining section 20*f* is provided at the front end side of the vehicle handle 20 and a rear-side joining section 20*e* is provided at the rear end side, and the front side joining section 20*f* and the rear-side joining section 20*e* are used for a purpose of joining between the door panel 10.

In this embodiment, as shown in FIG. 4, a configuration extending a wire harness 220 of the antenna assembly 210 and other components (unlock operation sensor 22, lock operation switch 23, etc.) from the vicinity of a tip side joining section to the door panel 10 side (top side of figure) is employed.

Figure 5:
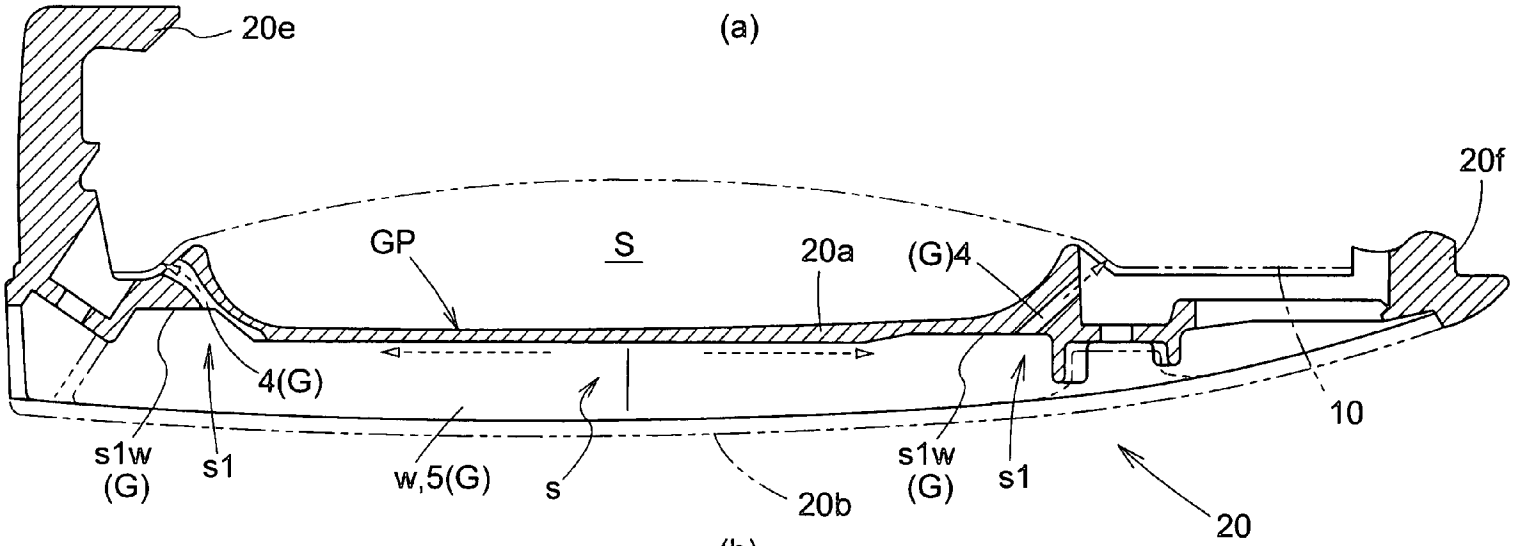
FIG. 5(*a*)-(*b*): Explanation drawings of an internal water discharging path.
Figure 5:
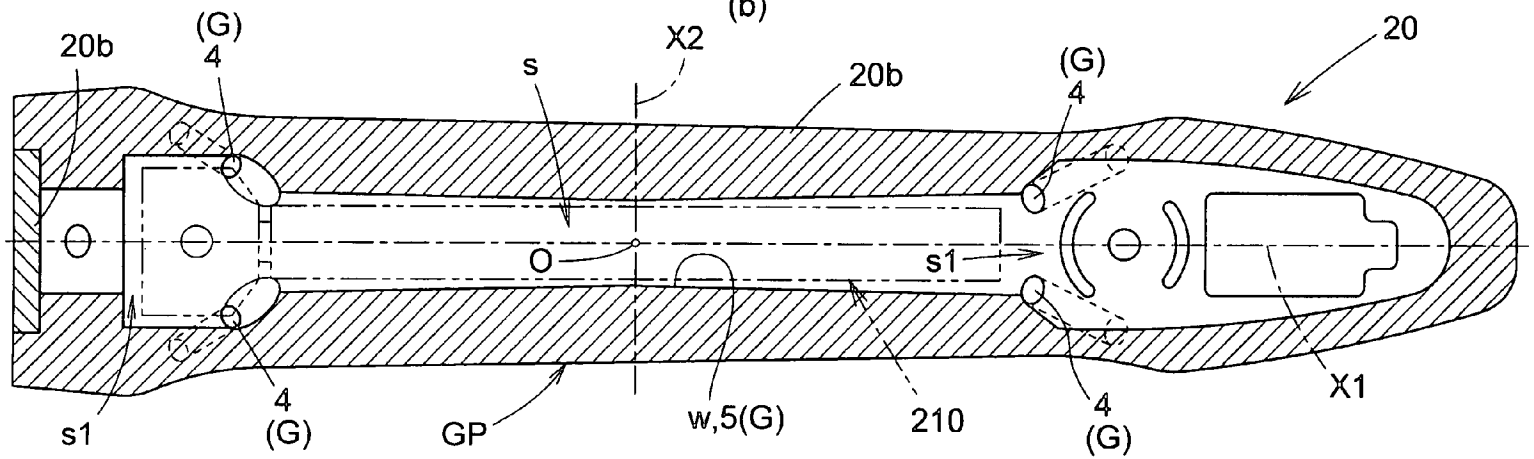

FIG. 5(*a*) is a view showing a cross-section of the handle body 20*a* along A-A of FIG. 3, and FIG. 5(*b*) is a view showing an outline of an assembly condition when this is seen from an outer side (an opposite side to the door panel 10).

As shown in these figures, the handle body 20*a* is, in broad outline, configured with a concave-shape cross section, and is mutually engaged with the handle cover 20*b*. The handle cover 20*b* and the handle body 20*a* are, as shown in FIG. 4, fastened and mutually joined by screws 20*c* and 20*d*. As long as mutual joining is achieved, the joining method may also be adhesion, heat caulking, etc.

The antenna assembly 210 is clasped and fixed by the handle cover 20*b* and the handle body 20*a* at an end of an antenna, or in other words, a front side (front side joining section 20*f*) of the vehicle handle 20. A rear end of the antenna assembly 210 is clasped and fixed by the lock operation switch 23. The center section 210*b* of the antenna assembly 210 is sandwiched by an buffer member 211 in order to prevent rattling.

3-2. Internal Water Processing of Vehicle Handle

In the vehicle handle 20 according to the present application, an internal water discharging path G communicating between the handle interior space s and the handle exterior space S and capable of discharging water inside the handle interior space s to the above-mentioned handle exterior space S is provided.

As shown in FIG. 5, the vehicle handle 20 is joined to the door panel 10 by handle joining sections constituted by the front side joining section 20*f* of the front end side and the rear-side joining section 20*e* of the rear end side. In the example of FIG. 5(*b*), an axis X1 of a longitudinal direction of the grip section GP and a centerline X2 perpendicularly crossing the axis X1 and passing through a center O of the grip section GP are shown. In other words, the handle joining sections (front side joining section 20*f* and rear-side joining section 20*e*) are provided at both end sides along the axis X1 of the grip section GP. In these handle joining sections (front side joining section 20*f* and rear-side joining section 20*e*), a plurality of water extraction holes 4 communicating from the handle interior space s to the handle exterior space S are provided. These water extraction holes 4 are, in actuality, holes of a diameter of about 3 mm, and in this embodiment, are provided in 4 locations, front and rear, top and bottom. In other words, each water extraction hole 4 is disposed line symmetrically about the axis X1 and furthermore about the centerline X2 with respect to the other water extraction holes 4. Furthermore, the plurality of water extraction holes 4 are formed in a radial shape from the center O, which is the intersection of the axis X1 and the centerline X2, so as to become more distant from the axis X1 as the water extraction holes 4 extend to the handle joining sections.

Accordingly, regardless of whether the vehicle handle 20 is mounted on the left or the right when viewing the vehicle from the front, or in other words, regardless of how the vehicle handle 20 is rotated with the center O as a rotation axis and mounted, one of the water extraction holes 4 can be installed so as to communicate to the handle exterior space S at the tip side thereof, and in addition, to be oriented downward in a vertical direction communicating as far as the handle exterior space S. Furthermore, as a result of the water extraction holes 4 being provided in the vicinity of the handle joining sections 20*f*, 20*e*, the water extraction holes 4 can discharge water to the door panel 10 using a surface tension of the water.

Furthermore, of the plurality of water extraction holes 4, those water extraction holes not facing downward in a vertical direction are used as air holes between the handle interior space s and the handle exterior space S, and the extraction of water from the water extraction holes 4 can be made easier.

Figure 6:
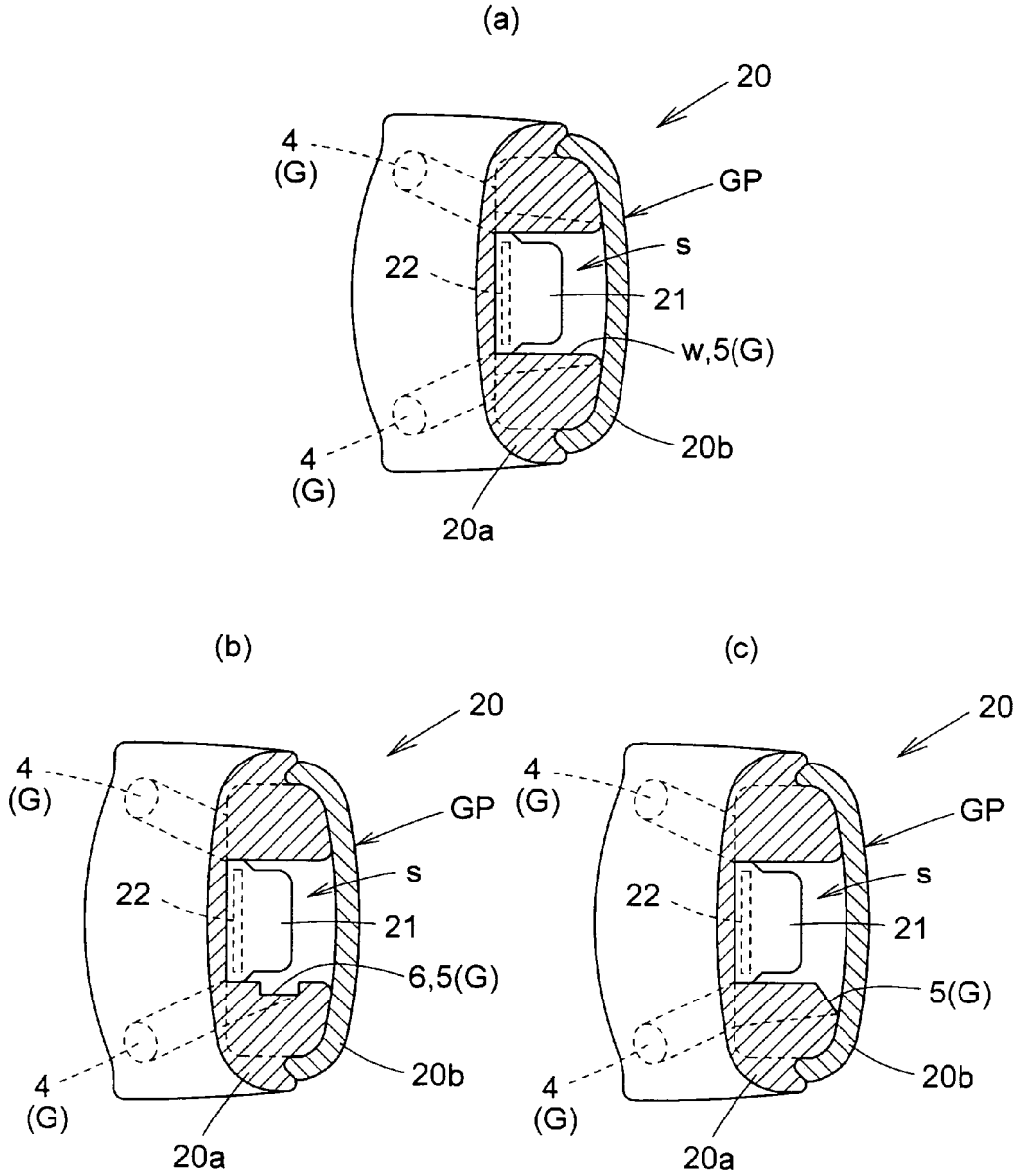
FIG. 6(*a*)-(*c*): Vertical cross-sectional views of the handle

In addition, as shown in FIG. 6(*a*), being a cross-section along B-B of FIG. 3, a water extraction guide path 5 directing the water inside the handle interior space s to the water extraction holes 4 is provided as a portion of the above-described internal water discharging path G in a handle inner wall surface w defining the handle interior space s. Accordingly, the internal water discharging path G is provided in the interval from the grip section GP to the handle joining section. The water extraction guide path 5 is, as shown in FIG. 5(*b*), configured so as to slope constantly downwards toward the tip thereof (having an inclination of about 10 degrees), and in a joining posture corresponding to a condition wherein the vehicle handle 20 is joined to the door panel 10, serves as a downward guide surface facing downward in a vertical direction. That is to say, similar to the above-mentioned water extraction holes 4, water extraction guide paths 5 are formed in a radial shape from the above-mentioned center O so as to become more distant from the axis X1 as the water extraction guide paths 5 extend the handle joining sections. In other words, the water extraction guide path 5 of this case is of a shape that progressively enlarges the flow path cross-section area wherein flowing of water is possible as proceeding from the center O to the handle joining section (or the handle exterior space S) to promote the flowing of water from the handle interior space s to the handle exterior space S. As a result, by reducing a resistance of the water as transition from the handle interior space s to the handle exterior space S takes place, water proceeding to the handle exterior space S becomes able to flow more easily.

Consequently, water having entered the handle interior space s is directed by the inclined water extraction guide paths 5, proceeds to the likewise-inclined water extraction holes 4, and is discharged towards the handle exterior space S from these holes 4.

A water extraction guide path 5 may, as shown in FIG. 6(*b*), being shown corresponding to FIG. 6(*a*), be configured as a channel 6 provided at a body-interior surface supporting the antenna assembly 210 of the handle body 20*a*, and furthermore, as shown in FIG. 6(*c*), may be provided at a mutual-engagement joining section of the handle body 20*a* and the handle cover 20*b*.

As shown in FIG. 5, the vicinities of the handle joining sections 20*f*, 20*e* are formed as relatively wide enlarged spaces s1 connected to the above-mentioned water extraction holes 4, and are configured such that the water within these enlarged spaces s1 is directed to the water extraction holes 4. As a result, a space partition wall s1*w* thereof is also configured so as to form the internal water discharging path G.

Figure 7:
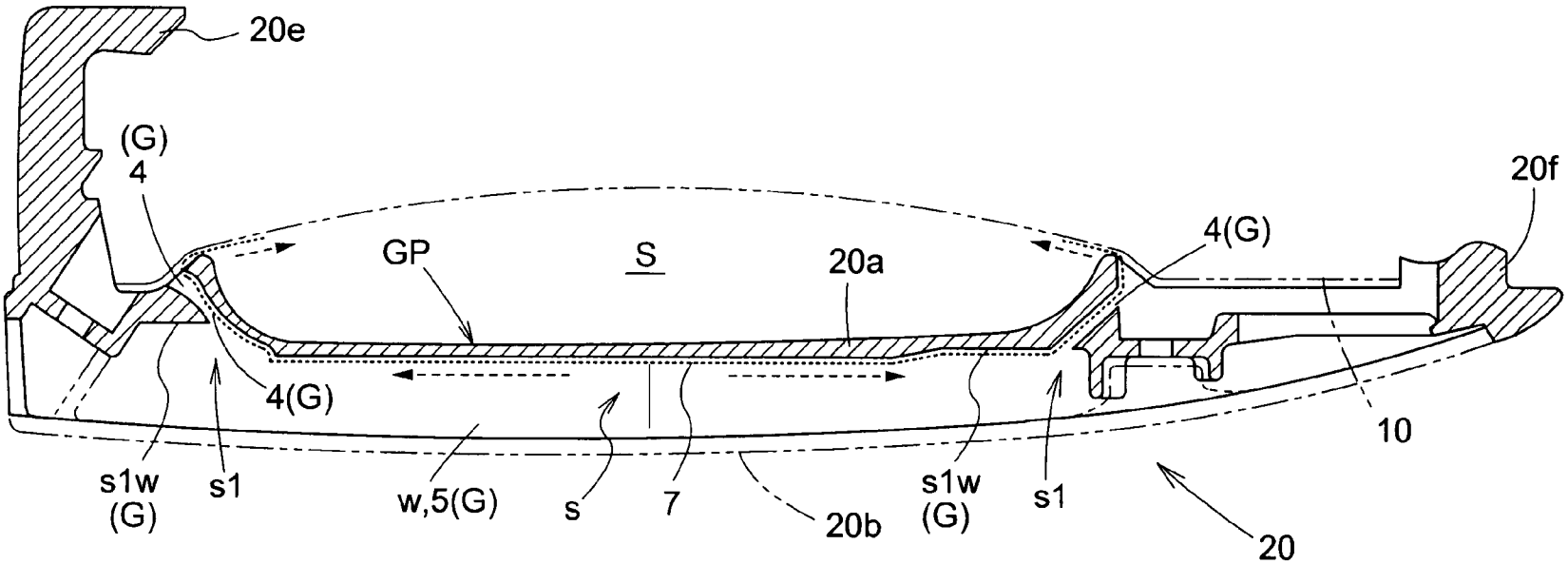
FIG. 7: Transverse direction cross-section view of a handle having non-woven cloth.

In the embodiment described thus far, although the internal water discharging path G is configured as a flow path for water, it is preferable with regard to an aim of promoting a motion of the water in this region, that non-woven cloth 7 be provided at the internal water discharging path G, as shown in FIG. 7. In other words, non-woven cloth 7 is provided at the internal water discharging path G, and is provided at least at the water extraction holes 4 and the above-mentioned handle exterior space region connected to the water extraction holes 4. In this way, by providing the non-woven cloth 7 for discharging water inside the handle interior space s to the handle exterior space S at the internal water discharging path G, the water inside the handle interior space s can follow the non-woven cloth 7. As a result, since the flow path of water extending from the handle interior space s to the handle exterior space S can be regulated by the non-woven cloth 7, the water is directed along the non-woven cloth and is easily discharged to the exterior.

In the above embodiment, although unlocking and locking operations of a door were described and no particular description was provided regarding notification to the user upon these operations, a mechanism notifying the user of operation by means of light pursuant to operations such as unlock preparation, unlock execution, lock preparation, and lock execution may be provided.

In the above embodiment, although an example employing a static-electricity capacity type sensor as the unlock operation sensor was presented, capacity type sensors on the whole can be used as a sensor of this type, and infrared sensors and proximity sensors using impedance, etc. may be used.

Figure 8:
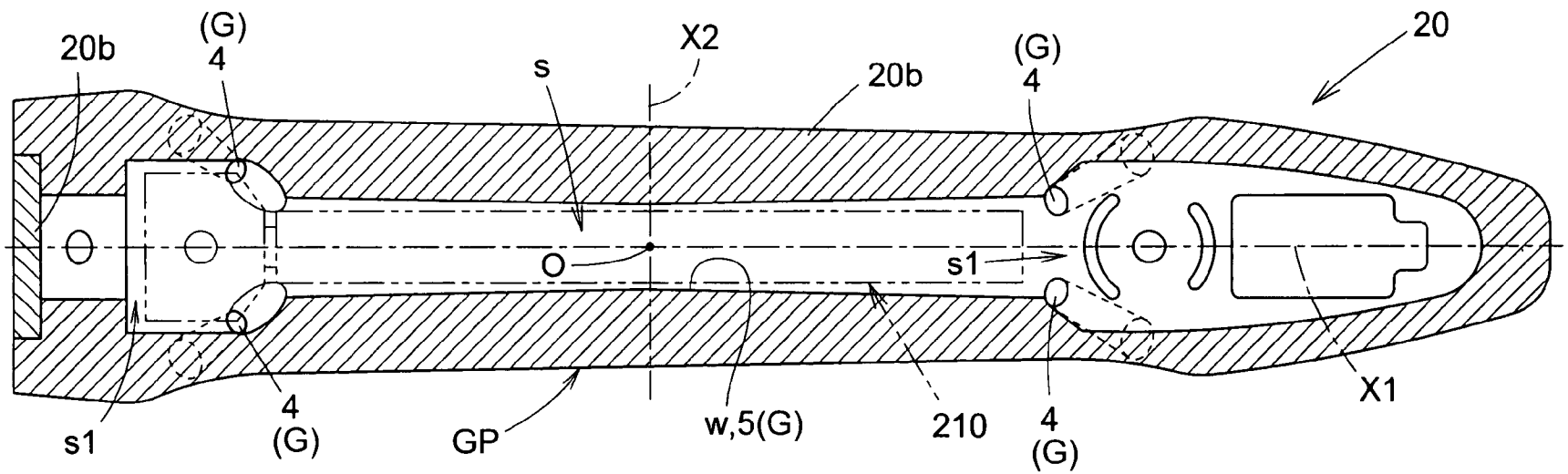
FIG. 8: Explanation drawing of an internal water discharging path.

In the above embodiment, although an example wherein the water extraction holes 4 are of a cylinder shape with a hole diameter of about 3 mm was presented, as shown in FIG. 7 and FIG. 8, the water extraction holes 4 may be formed such that the hole diameter becomes larger as transition from the handle interior space s to the handle exterior space S takes place. In other words, as the water extraction holes 4 of this case extend to the handle exterior space S, the flow path cross-section area wherein flowing of water is possible is progressively enlarged, and the water extraction holes 4 become shaped so as to promote the flowing of water from the handle interior space s to the handle exterior space S. As a result, by reducing a resistance of the water as transition from the handle interior space s to the handle exterior space S takes place, water proceeding to the handle exterior space S becomes able to flow more easily.

INDUSTRIAL APPLICABILITY

The handle for automobile according to the present application can be supplied for a smart entry system capable of guaranteeing favorable operation even in a poor environment wherein water enters the handle interior space.

The invention claimed is:

1. A vehicle handle comprising:

a grip having a handle cover and a handle body attached to the handle cover;

a handle joining section for operatively joining the grip with a door panel of a vehicle; and a non-contact detection sensor in a handle interior space defined by the handle cover and the handle body, and performing at least unlocking of a door in accordance with detection information from the detection sensor, wherein the vehicle handle further comprises an internal water discharging path provided in a portion of the grip which is operable relative to a door panel of a vehicle, and wherein the internal water discharging path establishes fluid communication between the handle interior space and a space between the door and the grip, and the internal water discharging path includes a plurality of water extraction holes which are provided symmetrically about at least one of a longitudinal axis or a centerline axis of the grip.

2. The vehicle handle of claim 1, wherein the internal water discharging path includes the plurality of water extraction holes being formed in the handle body for communicating from the handle interior space to the handle exterior.

3. The vehicle handle of claim 2, wherein the internal water discharging path includes at least one water extraction guide path provided at a handle inner wall surface defining the handle interior space for directing the water inside the handle interior space to the at least one water extraction hole.

4. The vehicle handle of claim 1, wherein the internal water discharging path includes a downward guide surface provided at a handle inner wall surface defining the handle interior space and facing downward in a vertical direction in a condition wherein the vehicle handle is joined to the door panel.

5. The vehicle handle of claim 1, wherein the internal water discharging path includes a portion of the internal water discharging path provided in a mutual-engagement joining section of the handle body and the handle cover.

6. The vehicle handle of claim 1, wherein the internal water discharging path includes a space provided in the vicinity of the handle joining section, and a wall of the space is formed as a portion of the internal water discharging path.

7. The vehicle handle of claim 1, wherein the handle joining section comprises first and second end handle joining sections provided at both longitudinal ends along an axis of the grip, and the internal water discharging path is formed so as to become more distant from the axis as the internal water discharging path extends from a center of the grip to the end handle joining sections.

8. The vehicle handle of claim 7, wherein the internal water discharging path is provided between the grip and the handle joining section.

9. The vehicle handle of claim 3, wherein a flow path cross-section area of the internal water discharging path wherein flowing of water is possible is progressively enlarged as the internal water discharging path extends towards the handle exterior space.

10. The vehicle handle of claim 2, wherein non-woven cloth is provided at the water extraction hole.

11. The vehicle handle of claim 2, wherein the at least one of the water extraction holes is formed in a side of the grip facing the door panel.

12. The vehicle handle of claim 11, further comprising four water extraction holes provided in a longitudinal direction and a vertical direction of the handle interior space.

13. The vehicle handle of claim 12, wherein the water extraction holes are radially formed relative to a center of the grip.

14. A vehicle handle comprising:

a grip having a handle cover and a handle body attached to the handle cover;

a handle joining section for operatively joining the grip with a door panel of a vehicle; and a non-contact detection sensor in a handle interior space defined by the handle cover and the handle body; and performing at least unlocking of a door in accordance with detection information from the detection sensor, wherein the handle joining section includes a front-side joining section provided at a front side of the vehicle handle and a rear-side joining section provided at a rear end side of the vehicle handle, one of the front-side joining section and the rear-end joining section acting as a pivotal point to allow the other of the front-side joining section and the rear-end joining section to move away from the door panel to operate the grip relative to the door panel, thereby providing a grip handle for opening the door, wherein a handle interior space is formed between the handle cover and the handle body, and wherein the vehicle handle further comprises an internal water discharging path provided in a portion of the grip which is operable relative to a door panel of a vehicle, wherein the internal water discharging path includes a plurality of water extraction holes which are provided symmetrically about at least one of a longitudinal axis or a centerline axis of the grip; and wherein the internal water discharging path establishes communication between the handle interior space and a space between the door and the grip such that the internal water discharging path is capable of discharging water that accumulates inside the handle interior space of the grip.

15. The vehicle handle of claim 14, wherein the internal water discharging path is provided in the handle body.

16. The vehicle handle of claim 14, wherein the internal water discharging path is formed in a side of the grip facing the door panel.

17. The vehicle handle of claim 1, wherein the internal water discharging path discharges water that accumulates inside the handle interior space of the grip.

18. The vehicle handle of claim 1, wherein the internal water discharging path is provided symmetrically about a longitudinal axis of the grip.

19. The vehicle handle of claim 1, wherein the internal water discharging path is provided symmetrically about a centerline axis of the grip.

20. The vehicle handle of claim 1, wherein the internal water discharging path is provided symmetrically about both a longitudinal axis and a centerline axis of the grip.

21. The vehicle handle of claim 14, wherein the internal water discharging path is provided symmetrically about a longitudinal axis of the grip.

22. The vehicle handle of claim 14, wherein the internal water discharging path is provided symmetrically about a centerline axis of the grip.

23. The vehicle handle of claim 14, wherein the internal water discharging path is provided symmetrically about both a longitudinal axis and a centerline axis of the grip.

24. The vehicle handle of claim 1, wherein the internal water discharging path includes at least four water extraction holes provided symmetrically about both a longitudinal axis and a centerline axis of the grip.

25. The vehicle handle of claim 14, wherein the internal water discharging path includes at least four water extraction holes provided symmetrically about both a longitudinal axis and a centerline axis of the grip.

* * * * *